United States Patent [19]

Sarrasin

[11] 4,023,797

[45] May 17, 1977

[54] HOCKEY PUCK TETHERING DEVICE

[76] Inventor: Maurice O. Sarrasin, 585 Bound Road, Woonsocket, R.I. 02895

[22] Filed: Oct. 29, 1975

[21] Appl. No.: 627,016

[52] U.S. Cl. ..... 273/1 B; 273/67 A

[51] Int. Cl.[2] ..... A63B 59/14

[58] Field of Search ..... 273/1 B, 26 B, 26 E, 273/29 A, 196, 200 R, 58 C, 95 A, 67 A, 97 R; 242/107, 107.2

[56] References Cited

UNITED STATES PATENTS

| | | | |
|---|---|---|---|
| 1,975,419 | 10/1934 | Grube | 242/107.2 |
| 2,105,462 | 1/1938 | Brinkman | 273/97 R |
| 3,065,563 | 11/1962 | Bascom | 273/200 R |
| 3,376,037 | 4/1968 | Lepselter | 273/26 B |
| 3,655,190 | 4/1972 | Lemon | 273/95 A |
| 3,731,925 | 5/1973 | Caldwell | 273/26 E |
| 3,863,917 | 2/1975 | Beale | 273/1 B |

*Primary Examiner*—William H. Grieb
*Attorney, Agent, or Firm*—Clarence A. O'Brien; Harvey B. Jacobson

[57] ABSTRACT

A hockey puck tethering practice and training device for developing stick handling skills has a tethering line attached to a hockey puck and wound on the spool of a reel assembly mounted on a hockey stick. The tethering line is protected by a shock-absorber arrangement associated with the reel assembly and the puck against breaking due to sudden, excessive forces exerted on the tethering line due to the movement of the puck.

8 Claims, 5 Drawing Figures

HOCKEY PUCK TETHERING DEVICE

SUMMARY OF THE INVENTION

1. Field of the Invention

This invention relates generally to an appliance which facilitates the training of athletes and particularly to a device for tethering a hockey puck on a hockey stick so as to facilitate the teaching of the skills of handling a hockey stick.

2, Description of the Prior Art

It is generally known to tether a ball to an appropriate instrument, such as a simulated baseball bat or a golf club. Examples of such tethered balls employed as practice devices may be found in U.S. Pat. Nos. 3,065,563, issued Nov. 27, 1962 to D. F. Bascom, and 3,731,925, issued May 8, 1973 to J. N. Caldwell. The construction of these known devices, however, is such as to limit their use essentially to the sports, namely, golf and baseball, for which the devices are specifically intended.

It is also known to tether a ball in order to construct an amusement device. Examples of such tethered-ball amusement devices may be found in U.S. Pat. Nos. 2,105,462, issued Jan. 18,1938 to A. Brinkman, 3,376,037, issued Apr. 2, 1968 to I. Lepselter, and 3,655,190, issued Apr. 11, 1972 to G. E. Lemon. Once again, however, these known tethered-ball amusement devices are constructed to perform a specific function, and are not suited for adaption to another function.

SUMMARY OF THE INVENTION

It is an object of the present invention to provide a device which will allow, for example, a boy or girl to learn how to stick handle a hockey stick accurately without loosing the puck, and to allow the student to get the feel of the puck quicker. It is another object of the present invention to permit one learning to "stick handle" accurately with a hockey stick to be able to control the hockey puck "heads up", "or without watching the puck, which is the correct way to stick handle.

These and other objects are achieved according to the present invention by providing a hockey puck handler practice and training device having: a tethering line attached to a hockey puck; and a reel assembly removably mounted on the handle of a hockey stick, with the tethering line wound about a spool of the reel assembly for permitting the line to vary in length. By this arrangement, the hockey puck will be permitted to travel a predetermined distance, set by the length of the line on the spool, when the hockey puck is struck by the blade of the hockey stick. The provision of a crank affixed to the spool of the reel assembly will permit the tethering line to be rewound onto the spool whenever the puck is moved a distance from the blade of the hockey stick a distance greater than that desirable for conducting stick handling practice.

The tethering line is advantageously cushioned both at the juncture of the line with a housing of the reel assembly and at the attachment of the tethering line to the hockey puck. This cushioning prevents extreme forces placed on the tethering line by impact of the blade at the hockey stick with the hockey puck from causing the tethering line to separate.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
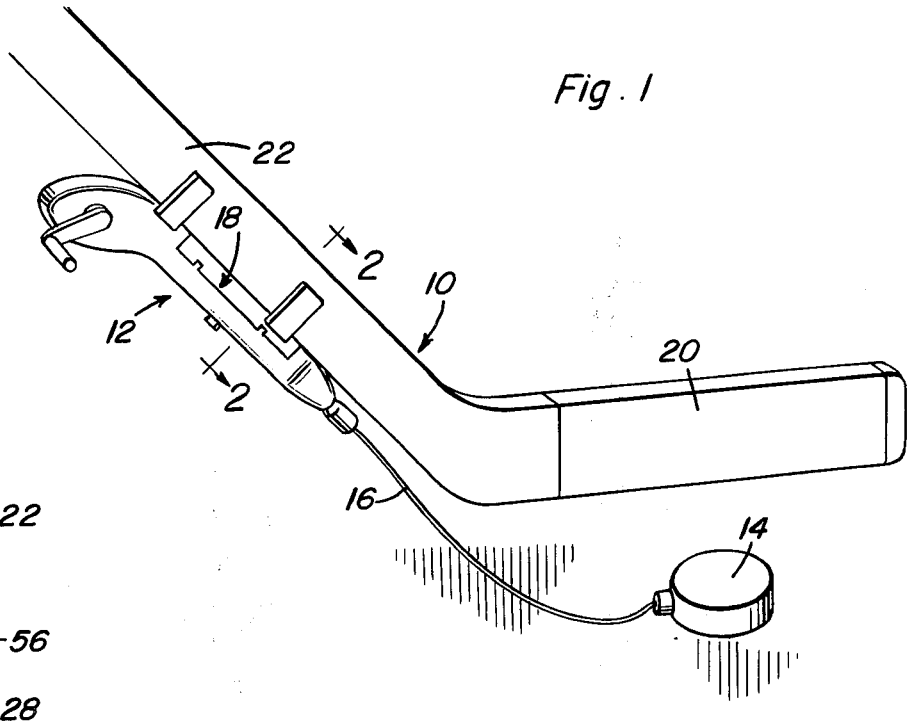
FIG. 1 is a schematic, perspective view showing a hockey puck handler practice and training device according to the present invention mounted on a hockey stick.
Figure 2:
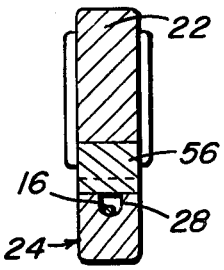
FIG. 2 is a sectional view generally along the line 2—2 of FIG. 1, but drawn to a larger scale.
Figure 3:
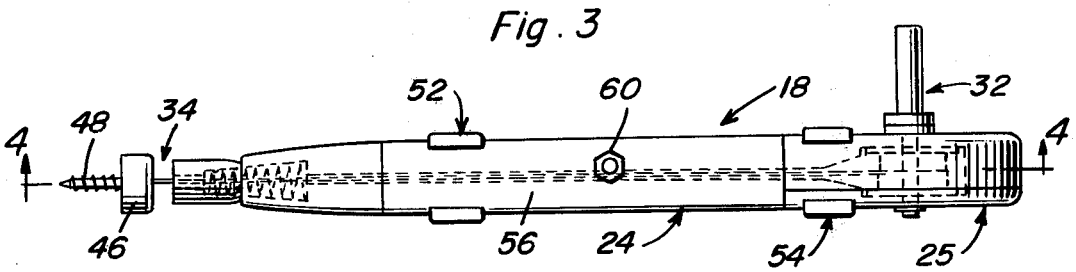
FIG. 3 is a top plan view of the hockey puck tethering device shown in FIGS. 1 and 2.
Figure 4:
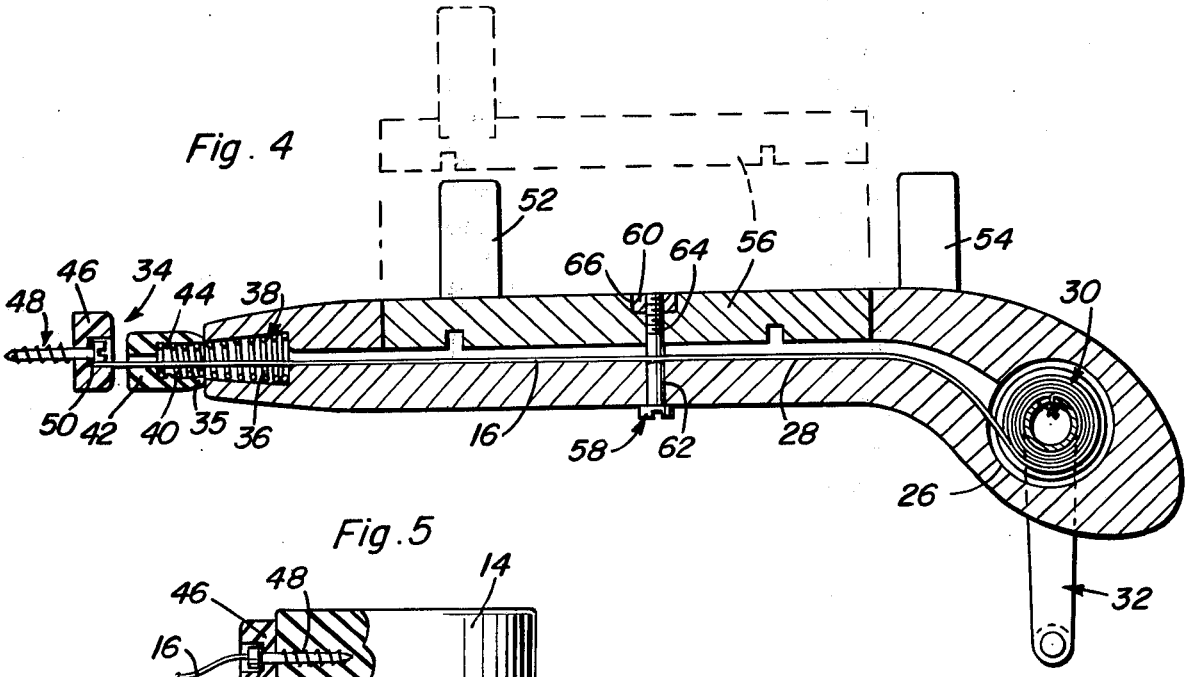
FIG. 4 is a sectional view taken generally along the line 4—4 of FIG. 3, but drawn to a larger scale.
Figure 5:
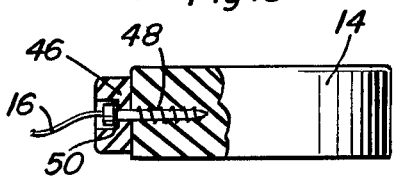
FIG. 5 is a side elevational view, partly cut away and in section, showing the attachment of the hockey puck to the tethering line of a hockey puck tethering device according to the present invention.

Referring now more particularly to FIG. 1 of the drawings, a hockey stick 10 is illustrated as provided with a hockey puck tethering device 12 according to the present invention. As shown, connected to a conventional hockey puck 14 is a tethering line 16, which can be a suitable length of string, cord, and the like, of sufficient strength to withstand the forces placed upon line 16. A real assembly 18 is mounted on hockey stick 10, and tethering line 16 is windably connected to the reel means for permitting line 16 to vary in length.

Hockey stick 10 includes, in the conventional manner, a blade 20 and a handle 22, with the reel assembly 18 being removably mounted on handle 22 adjacent blade 20, as is clearly shown in FIG. 1.

Referring now more particularly to FIGS. 2 through 5 of the drawings, a preferred form of reel assembly 18 includes a housing 24 provided with a cavity 26 and a passage 28 communicating with cavity 26. As can be clearly seen from FIGS. 3 and 4 of the drawings, housing 24 is advantageously a longitudinally extending member having an enlarged, downwardly extending portion, seen in the right hand side of FIG. 4, somewhat in the manner of a pistol grip. A spool 30 is rotatably disposed within cavity 26, and line 16 is wound about the spool 30 so as to be wound and unwound by rotation of spool 30. Plate 25 is removable for access to the spool cavity. As mentioned above, spool 30 is rotatably journaled in housing 24 and may be selectively rotated by a person using hockey stick 10 as by rotation of crank 32 affixed to spool 30 in a conventional manner to facilitate winding or unwinding of line 16 on spool 30. A cushioning assembly 34 is partially connected to housing 24 at an opening 35 of passage 28 in housing 24, and partially connected to puck 14 for cushioning extreme forces on line 16 and preventing line 16 from separating.

Cushioning assembly 34 preferably includes a tapered recess 36 provided in housing 24 concentric with passage 28 disposed receiving a tapered coiled spring 38. Recess 36 and spring 38 both taper toward the opening 35 of passge 28, with spring 38 having a portion 40 extending outwardly from housing 24. A counterbored, resilient plug 42, which may be constructed from rubber, and the like, is disposed on line 16 and screwed onto the outwardly extending portion 40 of spring 38 so as to be resiliently mounted onto housing 24. A resilient element 46, which may be constructed from a material similar to that used for plug 42, is attached to line 16 and to puck 14 as by a conventional wood screw 48, and the like, preferably disposed with the head of the screw within recess 50 provided in element 46. As can be readily seen from FIGS. 4 and 5 of the drawings, line 16 is retained on element 46, and thus puck 14, by placement of an end of line 16 beneath the head of screw 48.

Housing 24 includes, for example, two pairs of substantially parallel, transversely spaced mounting brackets 52 and 54 attached to housing 24 as along upper side portions thereof and oriented extending in a common direction. The spacing of brackets 52, 54 should be equal to the width of a conventional hockey stick handle. The brackets 52, 54 may be secured on a handle 22 of a hockey stick 10 as by a friction fit, although it is advantageous to employ a suitable adhesive, nails, screws, and the like, to insure that housing 24 will be securely retained on stick 10.

A section 56 of housing 24 is selectively removable in order to provide access to passage 28 of housing 24 and facilitate replacement of line 16 should the line separate within housing 24, or if it is desired to place a new length of line 16 on the spool 30. A illustrated, section 56 may be selectively retained on the main portion of housing 24 as by a conventional bolt 58 and cooperating nut 60. The shank of bolt 58 passes through holes 62 and 64 provided in the main portion of housing 24 and in section 56, while it is advantageous to provide a countersunk bore 66 in section 56 to receive nut 60.

As can be appreciated from the above description and from the drawings, a hockey puck tethering device according to the present invention will allow a boy or girl to learn to stick handle accurately without loosing the puck, and allow them to get the feel of the puck quicker, while permitting them to control the puck with their heads up, which is the correct or prescribed manner of stick handling. The present invention can be used by persons of all ages, including those just old enough to be on skates. It is advantageous to coaches and hockey schools. Further, these students can skate for any length of time without loosing the puck.

The puck handling device is versatile in that it can be used on either left handed hockey sticks, the right handed hockey sticks, or on neutral hockey sticks.

Stick handling is the basic skill of hockey. Therefore, the hockey puck tethering device according to the present invention is particularly advantageous in that it will facilitate more rapid learning of stick handling by anyone who uses the device.

While the amount of string, and the like, used as line 16 may vary, it has been found satisfactory to use nylon string adjustable in length from zero to two feet. The spool forming the winding and unwinding portion of the reel assembly may contain up to three feet of string satisfactorily. A particularly advantageous feature of the invention allows for a plastic tube, and the like, (not shown) to form passage 28 within housing 24.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a hockey stick and a hockey puck, a hockey puck handler practice and training device, comprising means for developing stick handling skills including:

a. a tethering line connected to the hockey puck;
b. reel means mounted on the hockey stick and connected to the tethering line, the tethering line being attached to the reel means for permitting the line to vary in length, the reel means further including,
c. a housing provided with a cavity and a passage communicating with the cavity;
d. a spool rotatably disposed in the cavity, the tethering line being wound about the spool;
e. a crank affixed to the spool for facilitating winding of the tethering line onto the spool; and
f. cushioning means partially connected to the housing at an opening of the passage from the housing and partially connected to the puck for cushioning extreme forces on the tethering line and preventing the tethering line from separating during use of the device.

2. The structured as set forth in claim 1, wherein the housing includes a pair of substantially parallel, transversely spaced mounting brackets connected to the housing and oriented extending in a common direction for forming a pair of clamps, a section of the housing being removable to provide access to the passage and facilitating replacement of the tethering line.

3. In combination with a hockey stick and a hockey puck, a hockey puck handler practice and training device, comprising; a tethering line connected to the hockey puck; reel means mounted on the hockey stick and connected to the tethering line, the tethering line being attached to the reel means for permitting the line to vary in length; the reel means includes; a housing provided with a cavity and a passage communicating with the cavity; a spool rotatably disposed in the cavity, the tethering line being wound about the spool; a crank affixed to the spool for facilitating winding of the tethering line onto the spool; cushioning means partially connected to the housing at an opening of the passage from the housing and partially connected to the puck for cushioning extreme forces on the tethering line and preventing the tethering line from separating during use of the device; and the cushioning means includes a tapered recess provided in the housing concentric with the passage and adjacent the opening of the passage, a tapered coil spring disposed in the recess, the recess and spring tapering toward the opening of the passage, the spring having a portion extending outwardly from the housing, a countebored resilient plug disposed on the tethering line and screwed onto the spring by the counterbore, and a resilient element attached to the tethering line and the puck for cushioning the attachment of the puck, the resilient plug and spring cooperating to form a resilient interface between the tethering line and the housing, and the resilient element forming a resilient connection of the tethering line to the hockey puck.

4. A structure as set forth in claim 3, wherein the hockey stick includes a blade and handle, with the reel means being removable and mounted on the handle adjacent the blade.

5. A structure as defined in claim 4, wherein the housing includes a pair of substantially parallel, transversely spaced mounting brackets connected to the housing and oriented extending in a common direction for forming a pair of clamps, a section of the housing being removable to provide access to the passage and facilitating replacement of the tethering line.

6. A hockey puck tethering device comprising, in combination: means for developing hockey stick handling skills including; a tethering line; reel means mountable on a hockey stick and connected to the tethering line, the tethering line being attached to the reel means so as to permit the tethering line to vary in length; the reel means includes, a housing provided wih a cavity and a passage communicating with the cavity; a spool rotatably disposed in the cavity, the tethering line being wound about the spool; a crack affixed to the spool for facilitating windig of the tethering line onto the spool; and cushioning means partially connected to the housing at an opening of the passage from the housing and partially connected to a hockey puck for cushioning extreme forces on the tethering line and preventing the line from separating during impact between a hockey stick associated with the reel means and a puck connected to the tethering line.

7. A structure as defined in claim 6, wherein the hockey stick includes a blade and handle, with the reel means being removably mounted on the handle adjacent the blade.

8. A structure as defined in claim 6, wherein the housing includes a pair of substantially parallel, transversely spaced mounting brackets connected to the housing and oriented extending in a common direction for forming a pair of clamps, a section of the housing being removable to provide access to the passage and facilitating replacement of the tethering line.

* * * * *